US006967550B2

(12) United States Patent
Elendt et al.

(10) Patent No.: US 6,967,550 B2
(45) Date of Patent: Nov. 22, 2005

(54) ELECTROMAGNETIC REGULATING DEVICE

(75) Inventors: Harald Elendt, Strullendorf (DE); Christof Faria, Erlangen (DE); Matthias Dittrich, Eggolsheim (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/790,511

(22) Filed: Mar. 1, 2004

(65) Prior Publication Data

US 2004/0201441 A1 Oct. 14, 2004

Related U.S. Application Data

(63) Continuation of application No. PCT/EP02/09677, filed on Aug. 30, 2002.

(30) Foreign Application Priority Data

Sep. 1, 2001 (DE) ..... 201 14 466 U

(51) Int. Cl.[7] ..... H01F 7/08
(52) U.S. Cl. ..... 335/229; 335/220; 335/179; 123/90.11
(58) Field of Search ..... 335/220–229, 335/254, 256, 268, 278; 123/90.11; 251/129.01–19

(56) References Cited

U.S. PATENT DOCUMENTS

| | | | | |
|---|---|---|---|---|
| 2,915,681 A | | 12/1959 | Troy | |
| 4,470,030 A | * | 9/1984 | Myers | 335/228 |
| 5,546,063 A | | 8/1996 | Hoffman | |
| 5,983,847 A | * | 11/1999 | Miyoshi et al. | 123/90.11 |
| 5,996,628 A | * | 12/1999 | Najmolhoda et al. | 137/625.61 |

FOREIGN PATENT DOCUMENTS

| | | |
|---|---|---|
| DE | 34 23 469 A1 | 1/1986 |
| DE | 197 22 013 A1 | 12/1998 |
| DE | 197 56 017 A1 | 6/1999 |

OTHER PUBLICATIONS

"Fast-Acting Long-Stroke Bistable Solenoids with Moving Permanent Magnets", *IEEE Transactions on Industry Applications*, vol. 26, No. 3, May-Jun. 1990.

* cited by examiner

*Primary Examiner*—Lincoln Donovan
(74) *Attorney, Agent, or Firm*—Volpe and Koenig, P.C.

(57) ABSTRACT

An electromagnetic regulating device with a movable actuator (42), especially a piston, having an engagement region (44) on an end thereof, and a coil device (34, 36), which is stationary relative to the actuator and which is designed to exert a force on the actuator. The electromagnetic regulating device is provided with permanent magnet means, through which the actuator (42) is held to the coil device (34, 36) in the inactive state of the coil device (34, 36) and wherein when current is applied to the coil device (34, 36), the actuator (42) is released from the coil device (34, 36), overcoming a retaining force of the permanent magnet means.

14 Claims, 1 Drawing Sheet

ELECTROMAGNETIC REGULATING DEVICE

CROSS-REFERENCE TO RELATED APPLICATIONS

This application is a continuation of PCT/EP02/09677, filed Aug. 30, 2002.

BACKGROUND

The present invention relates to an electromagnetic regulating device, with a movable actuator, such as a piston, forming on the end an engagement region, and a coil device, which is stationary relative to the actuator and which is designed to exert a force on the actuator.

Such devices are generally known, e.g., in the form of regulating devices with permanent electromagnets, and are used for a wide range of purposes. The basic principle is that a piston is guided in a housing as an actuator, which has an engagement region on one end for the regulating task, and can typically be moved out of the housing by means of an electromagnet provided in the housing against the force of a restoring spring.

FIG. 3 illustrates such a known regulating device in a sectional side view. A piston element 10, guided in a housing 12 and pretensioned against the force of a restoring spring 14, has on one end an engagement region 16, which projects out of the housing 12, and on the other end a press-on, hollow, cylindrical anchor 18, which can be moved through a predetermined path along a cylindrical contact surface in a yoke element 20 of an electromagnet (formed by coil 22 in the coil housing 24), whereby the engagement region 16 (FIG. 3 shows the pulled back or pushed in operating state) extends out from the end of the housing on the engagement side.

As clearly indicated by FIG. 3, the structural realization of such a device is expensive and not uncritical, especially in terms of fit and tolerances. Therefore, during production and assembly, it is necessary to form tolerances of the appropriate bearing (e.g., bearing 26) as well as the contact surfaces in a controlled fashion. In addition, the mechanical installation, e.g., relative to the conical region 28 adapted to the magnetization characteristic curve, is not unproblematic. Because the device shown in FIG. 3 also requires continuous application of the signal to the electromagnets at all positions, i.e., pushing out of the engagement region 16 from the housing, this creates further problems in terms of control and electronics. Therefore, in particular, different switching and holding currents must be controlled and, in general, there is the problem of a permanent (and according to the particular application, also not inconsiderable) current consumption for an extended piston, because this must be held permanently against the force of the restoring spring 14 in the extended position. Therefore, especially for energy-critical applications, for which, e.g., only portable current supply means are available, there is also a need for improvement in this direction.

SUMMARY

Therefore, the object of the present invention is to improve an electromagnetic regulating device of this type both in terms of mechanical and also electrical properties. In particular, this includes simplifying the assembly and fitting properties of the moving parts relative to the fixed parts and reducing the current consumption of such a device, especially in an extended (regulating) state.

The object is achieved by the device with the features of the main claim; advantageous refinements of the invention are described in the subordinate claims.

In an advantageous manner according to the invention, permanent magnet means, preferably provided as a disk-shaped permanent magnet corresponding to a cylindrical outer shape of the regulating device, are used. The properties of such a permanent magnet are utilized in several respects. First, the permanent magnet is used to retain the actuator securely in the housing in an (inserted) resting state through interaction with the core region. Second, the permanent magnet then has the effect, when the coil device according to the invention is excited in order to generate an opposing electromagnetic field, of creating a repulsion effect and thus an expulsion of the actuator from the associated housing, because according to the invention, the opposing field generated electromagnetically acts with the opposing force of repulsion on the permanent magnet and accordingly generates the forward motion of the actuator. Finally, the permanent magnet still offers the ability to guide the actuator back into its rest position in the core region for a deactivated electromagnetic counter field (i.e., deactivation of the coil current).

Thus, in an extremely simple and simultaneously effective way, a bi-stable regulating device is created, which requires only a one-time pulse-shaped current load of the coil device for leaving the rest position and moving the actuator and, as soon as the actuator is extended by the described repulsion effect and the permanent magnet has a sufficiently large distance from the core region, a stable extended state is also guaranteed in the deactivated state of the coil means. Moving the regulating means back into the rest state can then be performed either through external activation of the actuator (over the engagement region), as a supplement or alternative through suitably poled control of the coil device, correspondingly supported by an effective force of attraction of the permanent magnet starting from a predetermined distance to the core region.

In addition, it has been shown that such an arrangement can be produced in a relatively simple way in terms of structure and essentially without the critical tolerances and fits, so that in addition to the advantages in terms of control and energy, the regulating device according to the present invention also enables clear simplifications and cost advantages in production.

It is especially preferred to form the regulating device according to the invention with a force memory device formed as a spring. However, in contrast to the state of the art referred to above, here the spring force preferably acts in the extending direction of the actuator and thus counteracts the magnetic force of the permanent magnet. In addition to the stabilization of the actuator or piston movement achieved in this way, a quick and reliable movement of the piston from the housing can also be achieved, as soon as the retaining force of the permanent magnet has been overcome by means of the coil device. According to the structural realization, this force memory device can be realized either as a compression or tension spring.

In addition, it is especially preferred in terms of structure to form the stationary elements, i.e., the core region and coil device, in the shape of a ring or cylinder and to hold them in a cylindrical housing, for such a realization. The permanent magnet means can then be realized as a disk-shaped permanent magnet body approximately adapted to an effective area of the core region.

It has also been shown to be especially preferred for improving the magnetic flow of the permanent magnet to these magnetically conducting elements to further provide preferably two adjacent disks on both sides of a permanent magnet disk, wherein a preferred embodiment provides that these disk elements are adhered by an adhesive film, which is formed to absorb mechanical impulses, which might cause damage to the (brittle) permanent magnet material. For additional boundary protection of the permanent magnet and the entire arrangement, in particular also for protection against splitting of the magnet material, a protective ring is preferably provided at the edge, which, according to a refinement, is formed from a non-conductive material, e.g., plastic, and has an intended enclosing or encapsulating effect.

It has been shown to be especially suitable to use according to the invention in the field of motor vehicles and especially for motor regulation. By engaging the engagement range in a suitable regulating section of a cam shaft of an internal-combustion engine, a variable cam-shaft regulation can be realized in a favorable way in terms of regulation, with the present invention being distinguished by excellent mechanical regulating properties, closed, short regulating times and reliable regulating movements for simplified electronic regulation requirements. In particular, the use in connection with a cam shaft regulation also offers the especially elegant solution in terms of structure of limiting an effective stroke of the actuator not only by a grooved base of a corresponding regulating partner on the cam shaft (or another element), but also of performing an initial stroke movement of the actuator back in the direction towards the core region for introducing the intake operation.

Thus, the present invention produces the ability of combining an electromagnetic regulating device for a low-power regulating or switching operation, which is in no way limited to the preferred, but not exclusive translational regulating operation, with reliable mechanical operating properties and simple construction and simple adjustment. While the operation in connection with cam shaft regulation is the preferred use of the present invention, the possible applications appear to be almost limitless, especially in terms of enabling a bi-stable regulating and switching operation at low power.

BRIEF DESCRIPTION OF THE DRAWINGS

Further advantages, features, and details of the invention follow from the following description of preferred embodiments, as well as with reference to the drawings; shown here are.

DETAILED DESCRIPTION OF THE PREFERRED EMBODIMENT

Figure 1:
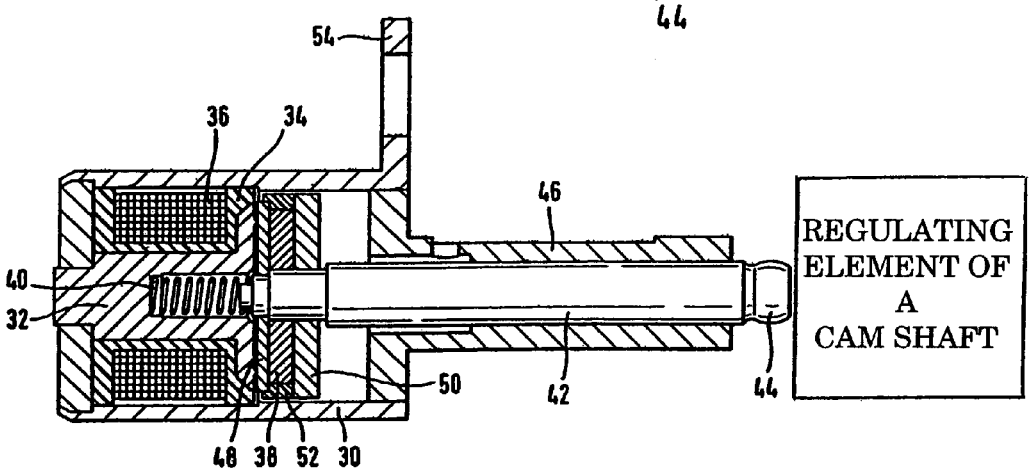
FIG. 1 is a longitudinal section through an electromagnetic regulating device according to a first preferred embodiment of the present invention.
Figure 3:
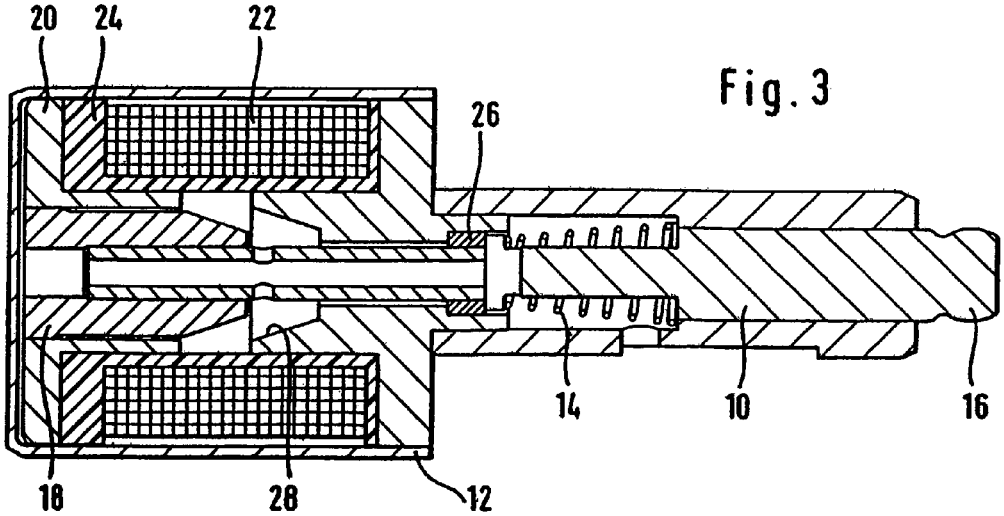
FIG. 3 is a view taken in longitudinal section similar to FIG. 1 of a regulating device as known from the state of the art.

As shown in FIG. 1, a cylindrical housing section 30 holds a core 32 made from magnetic material, which is surrounded by a coil 36 wound on a coil body 34.

On the inside, the core 32 forms an essentially planar flat side for interaction with a disk-shaped permanent magnet 38. A spiral spring 40 formed as a compression spring is held at the center in the core 32.

This acts against a piston 42 as an actuator so that through the spring force an engagement region 44 of the piston 42 at the end is guided out of a smaller diameter, elongated sleeve section 46 of the housing.

As can also be seen from FIG. 1, on both sides of the disk-shaped permanent magnet (made from common magnet material, e.g., Nd—Fe) there are disks 48, 50 made from magnetically conductive material (e.g., iron). The first disk 48, the permanent magnet disk 38, and the second disk 50 are connected to each other by means of thin adhesive film and therefore the structure has a certain pulse-damping effect. As can also be seen in FIG. 1, the arrangement is surrounded by a plastic ring 52, which has the object, in particular, of preventing chipping of material from the (brittle) permanent magnet disk or preventing the penetration of splinters or contaminants into the contact or movement region of the shown regulating device. As can be seen from FIG. 1, the appropriate edges of the permanent magnet (or of the plastic ring surrounding this magnet) and also the disks 48, 50 form a piston peripheral surface for a contact surface formed in the interior of the housing section 30.

Figure 2:
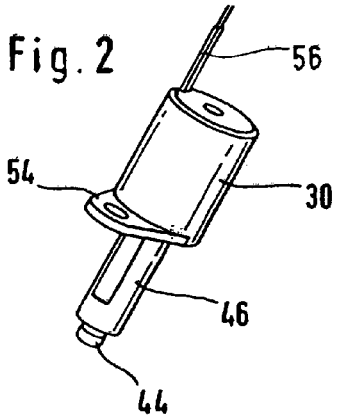
FIG. 2 is a perspective view of the entire device according to FIG. 1.

Thus, in the illustrated manner, a two-part housing is formed as a double cylinder, cf. FIG. 2, wherein the housing section 30 has an integral attachment flange 54 and the sleeve section 46 is finished as a separate housing part preferably made from non-magnetic steel and fitted into the housing section 30. FIG. 2 also shows schematic cable ends 56 for supplying current to the coil 36.

During operation of the arrangement according to FIGS. 1 and 2 without current applied to the coil 36, initially the arrangement made from piston 42 with tightly attached disks 48, 38, 50 is held on the core 32 through the effect of the permanent magnet 38. First a current applied to the coil 36 generates a magnetic field, which counteracts the field of the permanent magnet 38, displaces or deflects this into the disks 48, 50 and thus leads to repulsion. Here, supported by the force of the spiral spring 40 (which, as such, is not in the position to overcome the pure retaining force of the permanent magnet 38) the piston in the illustration from FIG. 1 is pushed out to the right from the sleeve section 46 of the housing and thus satisfies its switching or regulating function according to requirements. As soon as the spring force of the spring 40 is stronger than an attractive or restoring force of the permanent magnet 38, current applied to the coil 36 can also be removed and the arrangement is held, in a bi-stable way, in the drawn-out (extended) state of the engagement region 44, without requiring additional energy supply to the arrangement.

Moving the piston inwards or reversal of the regulating process can then be achieved by switching the poles of the coil current to be applied, so that a field is generated that attracts the permanent magnet 38 or the associated disks 48, 50, whereby then the piston is brought back into the original position according to FIG. 1, against the force of the spring 40. As an addition or alternative, this movement can be performed by an external pushing force on the piston 42 in the direction to the resting position shown in FIG. 1 until the permanent magnet itself can then effect the additional return by its magnetic force. Such a movement can be performed, e.g., by a regulating partner interacting with the regulating device, e.g., a correspondingly formed engagement groove.

The present invention finds an especially significant and effective practical application in connection with the regulation of internal-combustion engines, in particular, the (variable) cam setting for a cam shaft. Here, a suitable groove for the engagement region 44 of the piston 42 would not only limit the maximum stroke of the piston 42 by its correspondingly dimensioned grooved base (so that the disk 50 does not previously travel up to the stop formed by an inner surface of the sleeve section 46), this grooved base in a suitable way could also generate the release or return pulse for the return of the piston described above into the original position according to FIG. 1.

The present invention is not limited to the actually described embodiment or the exemplary application for the internal-combustion engine regulation. In particular the present invention can be realized in ways that are different from the shown translational movements according to FIGS. 1, 2 as the regulating device, so it is conceivable, in particular, that an embodiment of the invention (not shown in the figures) performs a rotational movement.

Furthermore, the structural arrangement of the individual systems within the regulating device is not fixed; not only can the spiral spring 40 shown in FIG. 1 be formed at different positions (also, e.g., as a tension spring), but the coil region can also be arranged in an opposite position relative to the piston.

Thus, as a result, the present invention produces various possibilities for combining a mechanical regulating device operating with very low consumption and extremely reliably with simplified electronic control and in particular also low-power bi-stable operation.

What is claimed is:

1. A regulating device for an internal-combustion engine for cam shaft regulation, the regulating device comprising a movable actuator (42) with an engagement region (44) on an end thereof and a coil device (34, 36), which is stationary relative to the actuator and which is adapted to exert a force on the actuator, a permanent magnet, which holds the actuator (42) in proximity to the coil device (34, 36) in an inactive state of the coil device (34, 36) and, upon application of a current to the coil device (34, 36), the actuator (42) is released from the coil device (34, 36), overcoming a retaining force of the permanent magnet means, wherein the engagement region (44) interacts with a corresponding regulating element of a cam shaft.

2. The regulating device according to claim 1, wherein the actuator (42) has a permanent magnet (38) which interacts with a stationary core region (32) of the coil device (34, 36).

3. The regulating device according to claim 1, wherein the actuator (42) interacts with a mechanical force storage device (40), which exerts a spring force counteracting the retaining force on the actuator (42).

4. The regulating device according to claim 2, further comprising a cylindrical housing (30) which encloses at least the coil device (34, 36) and a core region.

5. The regulating device according to claim 1, wherein the permanent magnet comprises at least one permanent magnetic disk (38) provided on an end region of the actuator (42) opposite the engagement region (44).

6. The regulating device according to claim 5, characterized in that the permanent magnetic disk includes a disk surface, which extends generally parallel to a surface of the core region (32).

7. The regulating device according to claim 5, wherein the actuator has a disk element (48) made from magnetically conductive material adjacent to the disk-shaped permanent magnet (38) in a direction towards the core region (32).

8. The regulating device according to claim 7, wherein a second disk element (50) made from magnetically conductive material is adjacent on an other end to the permanent magnet.

9. The regulating device according to claim 7, wherein at least one disk element is connected to the permanent magnet by an adhesive film.

10. The regulating device according to claim 7, wherein the permanent magnet and at least one disk element are enclosed at an edge thereof by a sleeve or capsule element (52) made from non-magnetic material.

11. The regulating device of claim 10, wherein the non-magnetic material is a plastic ring.

12. The regulating device according to claim 1, wherein the actuator (42) comprises an elongated piston that is guided by a portion of a housing of the regulating device which forms a tubular guidance section.

13. The regulating device of claim 12, wherein the portion of the housing forming the tubular guidance section is made from non-magnetic material.

14. The regulating device according to claim 1, wherein the regulating element is adapted to generate a restoring force in a direction of the retaining force of the permanent magnet and thus for creating a stroke movement of the actuator (42) by a predetermined stroke length, wherein the stroke length is set such that an actuator moved in this manner is adapted to be moved by the permanent magnet means (38) in a direction towards the core region (32).

* * * * *